US005797692A

United States Patent [19]

Poole et al.

[11] Patent Number: 5,797,692

[45] Date of Patent: Aug. 25, 1998

[54] APPARATUS AND METHOD FOR DISPENSING AND SPREADING FLOWABLE MATERIAL UPON A SURFACE

[76] Inventors: Daniel L. Poole, 23 E. Surrey, Phoenix, Ariz. 85022; Robert Poole, P.O. Box 2898, Pinetop, Ariz. 85935

[21] Appl. No.: 785,702

[22] Filed: Jan. 17, 1997

Related U.S. Application Data

[63] Continuation of Ser. No. 521,318, Aug. 30, 1995, abandoned.

[51] Int. Cl.[6] ..... B05C 17/00

[52] U.S. Cl. ..... 401/266; 401/139; 401/263

[58] Field of Search ..... 401/261, 263, 401/266, 139; 222/561, 545

[56] References Cited

U.S. PATENT DOCUMENTS

| | | | |
|---|---|---|---|
| 128,100 | 6/1872 | Bennett | 222/561 |
| 1,800,936 | 4/1931 | Ganger | 222/561 X |
| 1,890,599 | 12/1932 | Cobello | 401/263 |
| 2,066,792 | 1/1937 | McLeod | 401/266 |
| 2,186,644 | 1/1940 | Kates | 222/545 |
| 2,532,690 | 12/1950 | Zimmerman | 222/561 X |
| 2,665,038 | 1/1954 | Fowler | 222/561 |
| 2,772,432 | 12/1956 | Andreola | 401/263 |
| 2,930,063 | 3/1960 | Stull | 401/266 X |
| 3,174,661 | 3/1965 | Speicher | 222/545 |

FOREIGN PATENT DOCUMENTS

| | | | |
|---|---|---|---|
| 465717 | 5/1937 | United Kingdom | 222/561 |

*Primary Examiner*—Steven A. Bratlie

*Attorney, Agent, or Firm*—Parsons & Goltry; Robert A. Parsons; Michael W. Goltry

[57] ABSTRACT

An apparatus for dispensing and dispersing material, including a vessel having an open end and a dispensing element coupled to and closing the open end. The dispensing element having an aperture, and a carriage coupled to the dispensing element and movable between a closed position covering the aperture and an open position adjacent the aperture. The carriage having a surface for receiving a flowable material dispensed from the aperture in the open position.

9 Claims, 5 Drawing Sheets

FIG. 3
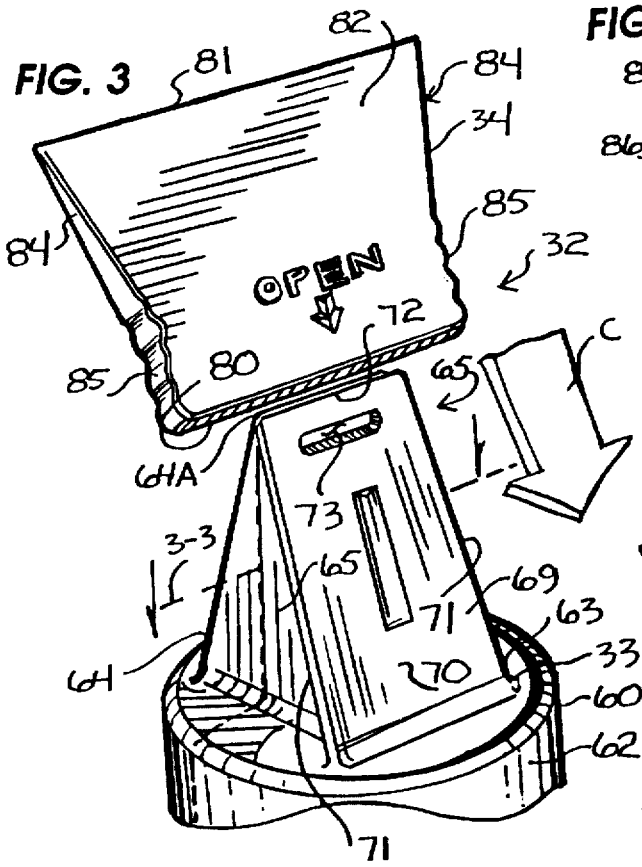
FIG. 4
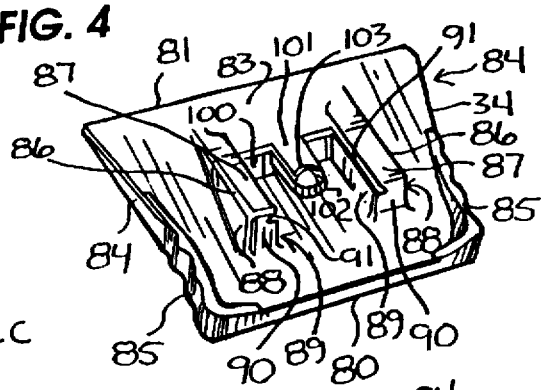
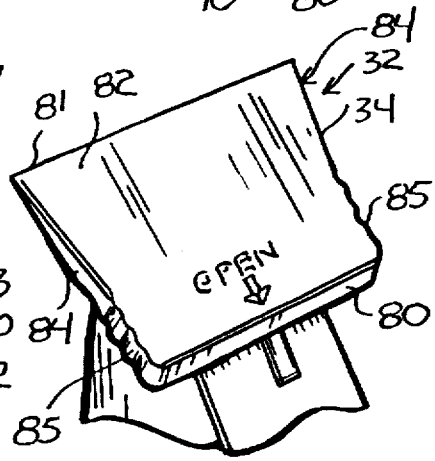
FIG. 5
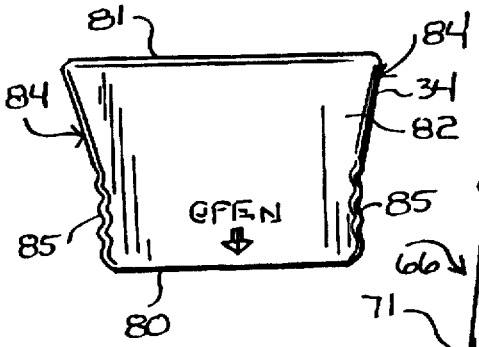
FIG. 6
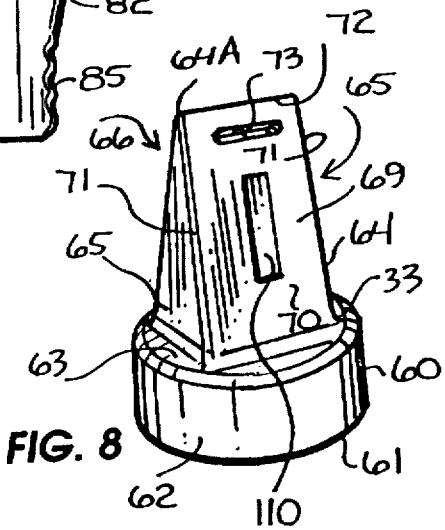
FIG. 8
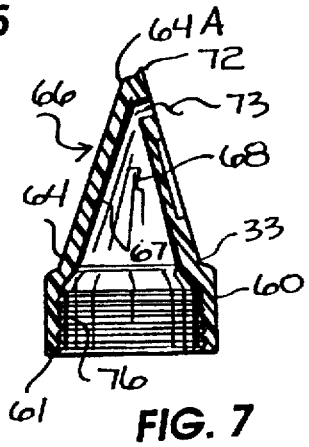
FIG. 7

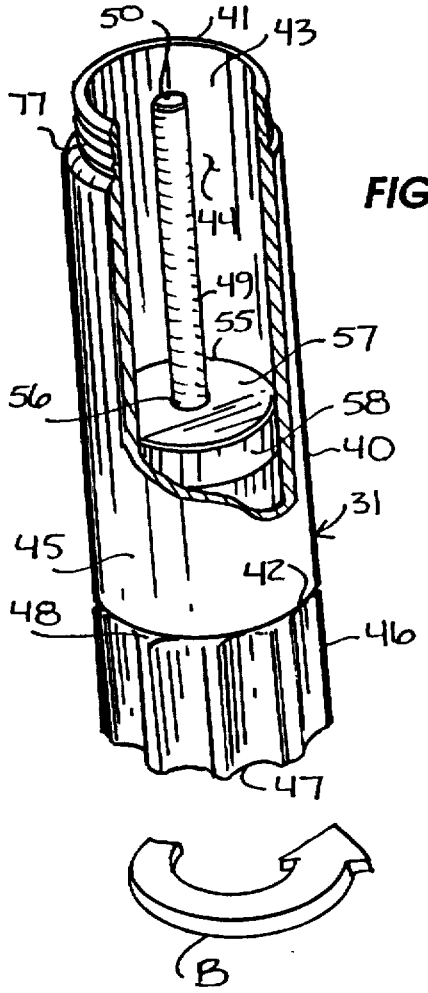
FIG. 9
FIG. 10
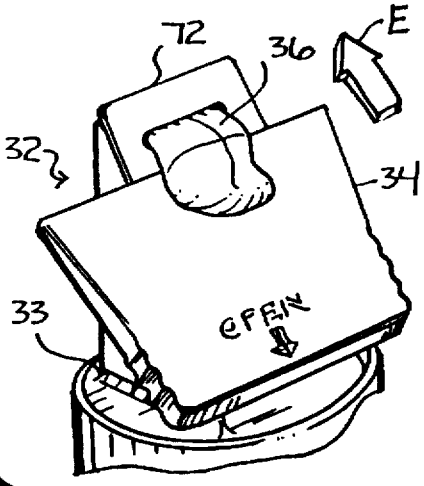
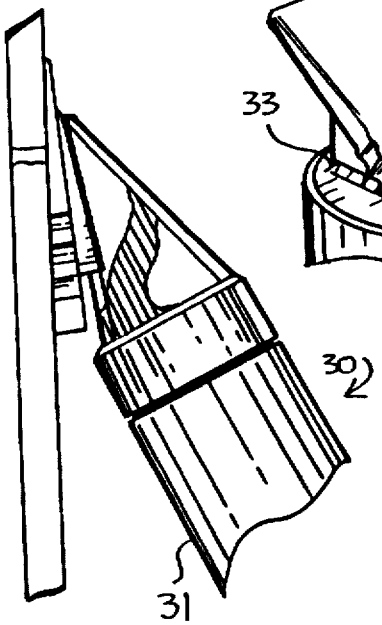
FIG. 11
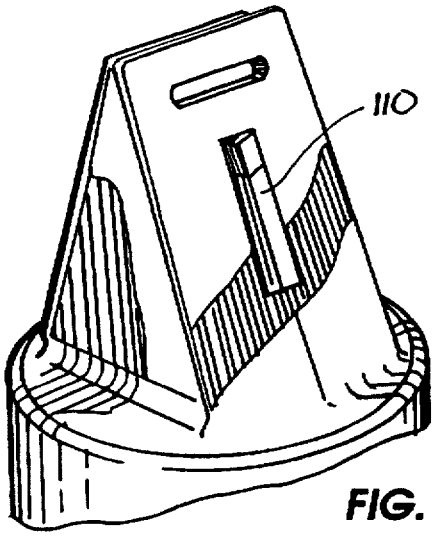
FIG. 12
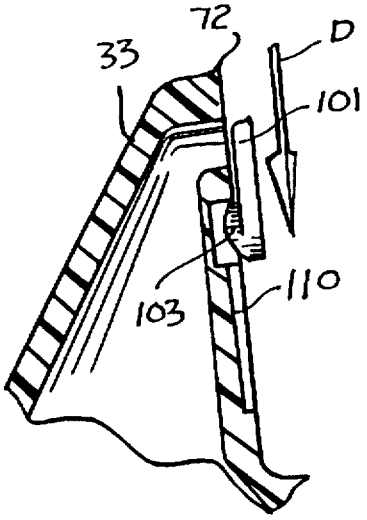
FIG. 13

FIG. 14
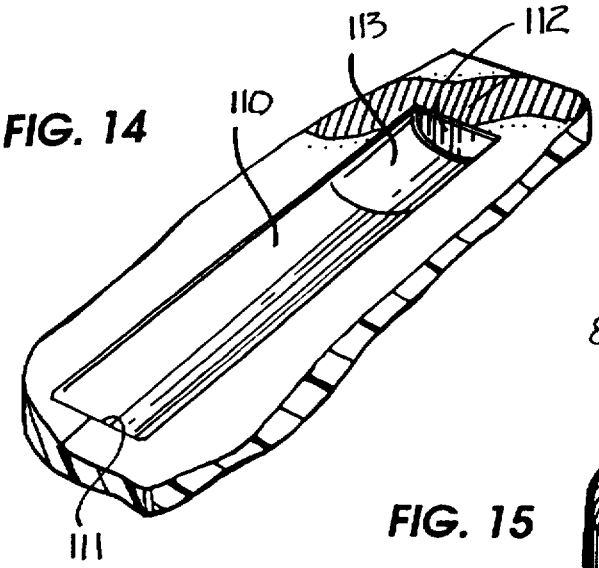
FIG. 15
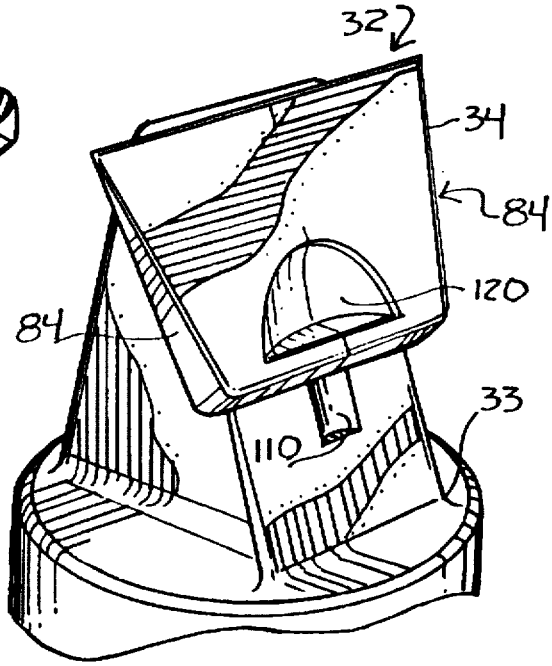
FIG. 16
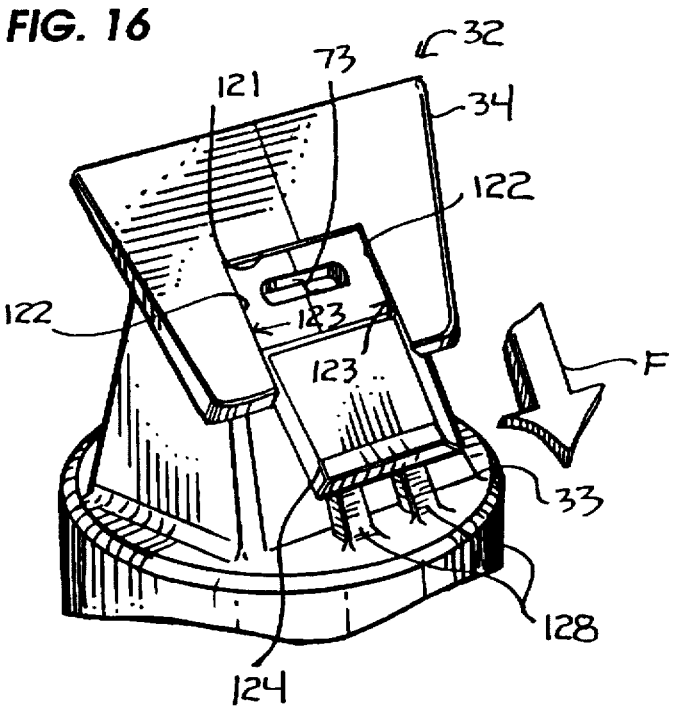
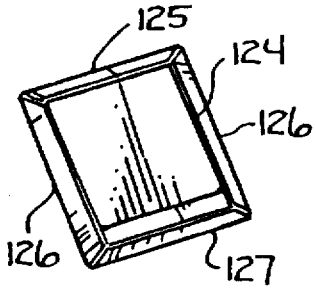
FIG. 17

APPARATUS AND METHOD FOR DISPENSING AND SPREADING FLOWABLE MATERIAL UPON A SURFACE

This application is a continuation of application Ser. No. 08/521,318 filed 30 Aug. 1995 now abandoned.

BACKGROUND OF THE INVENTION

1. Field of the Invention

This invention relates to the art of dispensers.

More particularly, this invention relates to devices for dispensing flowable material.

In a further and more specific aspect, the instant invention relates to a device for dispensing and spreading flowable material upon a surface.

2. Prior Art

There are many varieties of apparatus used specifically for dispersing or dispensing substances such as glue, spackle, caulking, and varying types of adhesives. There are also varieties of like apparatus used to dispense toothpaste, and food items such as mayonnaise, mustard, ketchup, and other food items appropriately usable therewith. Upon close examination of these apparatus, certain deficiencies inherent therein occasion the necessity of specific new and useful improvements.

Existent in the prior art are exemplary apparatus designed to dispense and apply flowable material to a surface. For instance, caulking guns are useful items incorporating a vessel for captively holding caulking, a dispensing opening or tip for dispensing the caulking therefrom, and a means for exerting force upon the caulking for facilitating the dispensing of the caulking through the open end for application of the flowable material to a desired surface. Typically, the dispensing tip of caulking guns of this sort are constructed of a flexibly resilient material such as plastic or the like, portions of which must be removed to form an opening from which material may be dispersed therefrom. Additionally, these apparatus normally employ an auxiliary capping member of a type that is frictionally retained about the opening of the dispensing tip for closing the opening of the dispensing tip when not in use. Though these apparatus are typically employed with substances such as caulking, it will readily be appreciated by those of ordinary skill that other adhesive-like materials are also used in combination therewith.

Although the foregoing apparatus illustrate ideal means for dispensing and applying flowable material to a surface, certain deficiencies become apparent upon close inspection. For instance, the capping member for closing the dispensing opening can often be misplaced or lost which can be frustrating to the user. Often, the dispensing opening can become clogged with hardened caulking or glue, which frequently leads to waste of unused caulking or glue. Additionally, although the above apparatus functions well as a dispensing tool, it is not typically designed for selectively spreading the flowable material over a selected surface. Normally, once material is dispensed therefrom, a separate tool such as a trowel must be used to smooth or spread the flowable material over the selected surface.

Also present in the prior are varieties of apparatus used specifically for dispensing adhesive materials such as glue. One such apparatus incorporates a flexible container for holding glue having an open end with a flexible dispensing member coupled to the open end. Glue may then be dispensed therefrom and applied to a surface by pressing the flexible dispensing member against a desired surface with sufficient force to open an aperture formed through the dispensing member, thus facilitating the flow of glue therethrough. Once the force is removed, the flexible dispensing member assumes its original configuration thereby closing the aperture. Other apparatus incorporate, instead of a flexible dispensing member, a threaded member which is closed in a first configuration and upon twisting, becomes open in a second configuration thereby allowing one to open and close an aperture from which glue may pass.

Although these adhesive dispensers are exemplary, the ends through which glue passes typically accumulate glue which dries, thereby clogging the aperture through which glue passes. This can be inconvenient and frustrating to the user, and can be difficult to clean. Also, these apparatus do not incorporate a means of spreading the glue or adhesive to a desired surface once dispensed.

Other types of apparatus are also present in the prior art that are used specifically in cooperation with food items. Of interest are apparatus used for dispensing ketchup, mustard, mayonnaise, and the like, which normally incorporate a substantially flexible container having an open end with a dispensing means coupled thereto for dispensing product from the container. Typical dispensing means include a capping member which may be threadably received by the opening of the container. The capping member normally includes a body having an aperture through which product may pass, and a lid, flexibly coupled to the body, which snap fits upon the body to seal the aperture when not in use. Also present are dispensing means similar to that which has been described above which includes a threaded element which may be twisted in a predetermined direction to either open an aperture for dispensing material therefrom, or for closing the aperture when not in use.

Although these apparatus are adequate for intended use, the same deficiencies which are inherent with respect to the above mentioned caulking guns and adhesive dispensers are existent therein.

It would be highly advantageous, therefore, to remedy the foregoing and other deficiencies inherent in the prior art.

Accordingly, it is an object of the present invention to provide improvements in apparatus for dispensing and applying material to a desired surface.

Another object of the present invention is provide an improved dispensing apparatus usable in combination with glues, adhesives, and like materials.

And another object of the present invention is to provide an improved dispensing apparatus usable in combination with food items such as ketchup, mustard, mayonnaise, and like food items.

Still another object of the present invention is to provide an improved dispensing apparatus that is easy and convenient to open and close.

Yet another object of the instant invention is to provide an improved dispensing apparatus for selectively spreading material over a desired surface.

Yet still another object of the instant invention is new and improved dispensing apparatus that is relatively simple and inexpensive to manufacture.

And a further object of the invention is to provide a new and useful method of dispensing and spreading material across a desired surface.

Still a further object of the immediate invention is to provide a dispensing apparatus that is easy to clean.

Yet a further object of the invention is to provide a new and improved dispensing apparatus for inhibiting waste of flowable material carried thereby.

SUMMARY OF THE INVENTION

Briefly, to achieve the desired objects of the instant invention in accordance with a preferred embodiment thereof, provided is an apparatus for dispensing and spreading a flowable material. The apparatus includes a vessel for holding a flowable material and having an end for dispensing the flowable material. Next provided is an dispensing assembly including a dispensing member detachably carried by the vessel for receiving the flowable material, and for dispensing the flowable material. The dispensing assembly further and desirably includes a carriage movably engageable with the dispensing member proximate the aperture. The carriage includes a lower surface for selectively concealing the aperture in a first configuration, and an upper surface for receiving flowable material dispensed from the aperture when the carriage is selectively disposed in a second configuration, the upper surface providing a spreading surface for selectively spreading the flowable material upon the surface.

Also provided is a method for dispensing and spreading a flowable material upon a surface, the method comprising providing a vessel for holding and dispensing a flowable material. The method further includes dispensing the flowable material from the vessel and receiving the flowable material by a dispensing assembly including a dispensing member having an aperture and a carriage movingly engageable thereto. The method still further includes the steps of opening the aperture, dispensing a selected amount of flowable material upon an upper surface of the carriage, closing the aperture, and selectively spreading the flowable material upon the surface.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 3 is an enlarged exploded perspective view of a preferred embodiment of a dispensing assembly having a dispensing element and a carriage;

FIG. 4 is a perspective view of the carriage shown FIG. 3;

FIG. 5 is a fragmentary view of the dispensing assembly similar to that shown in FIG. 3;

FIG. 6 is a front elevational view of the carriage shown in FIG. 5;

FIG. 7 is a sectional view of the dispensing element taken along line 3—3 of FIG. 3;

FIG. 8 is an enlarged perspective view of the dispensing element shown in FIG. 3;

FIG. 9 is a perspective view of the vessel of the instant invention constructed in accordance with the preferred embodiment with portions therein broken away for purposes of illustration;

FIG. 10 is an enlarged fragmentary perspective view of portions of the dispensing assembly further illustrating flowable material being dispensed therefrom;

FIG. 11 is a fragmentary side elevational view of the apparatus shown in FIG. 1;

FIG. 12 is an enlarged fragmentary perspective view of the dispensing element shown in FIG. 8;

FIG. 13 is an enlarged sectional view of portions of the dispensing element;

FIG. 14 is an enlarged perspective fragmentary view of portions of the dispensing element shown in FIG. 13;

FIG. 15 is an enlarged fragmentary perspective view of portions of the instant invention, further illustrating an alternate embodiment of the dispensing assembly;

FIG. 16 is an enlarged fragmentary perspective view, similar to that shown in FIG. 15, and further illustrating yet another embodiment of the dispensing assembly;

FIG. 17 is an enlarged perspective view of a portion of the alternate embodiment shown in FIG. 16;

DETAILED DESCRIPTION OF THE PREFERRED EMBODIMENT

Figure 1:
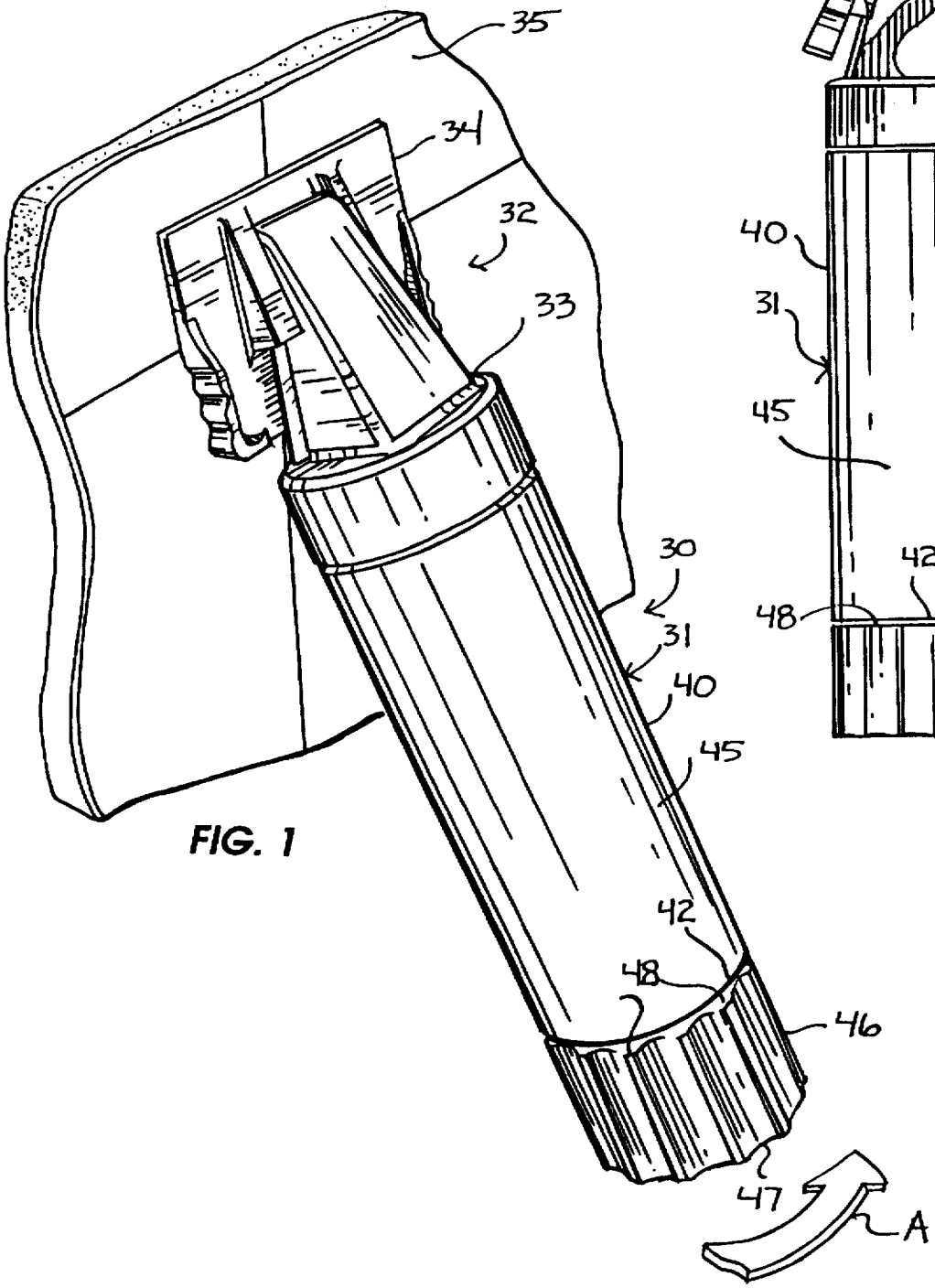
FIG. 1 is a perspective view of an embodiment of the instant invention incorporating improvements constructed in accordance with the teachings of the instant invention, and illustrating the instant invention as it would appear in use with a surface.

Turning now to the drawings, in which like reference characters indicate corresponding elements throughout the several views, attention is first directed to FIG. 1 which illustrates a first embodiment of the instant invention comprising a dispensing device for dispensing and spreading a flowable material upon a selected surface 35, the dispensing device being generally designated by the reference character 30. The dispensing device 30 includes a vessel 31 and a dispensing assembly 32 including a dispensing element 33 and a carriage 34 coupled thereto, the dispensing assembly comprising an expelling means for dispensing and spreading the flowable material, the flowable material being shown in FIG. 10 and being generally designated by the reference character 36. The dispensing device 30 shown in FIG. 1 is seen as it would appear in use in combination with surface 35, which can also be seen with reference to FIG. 11.

Figure 2:
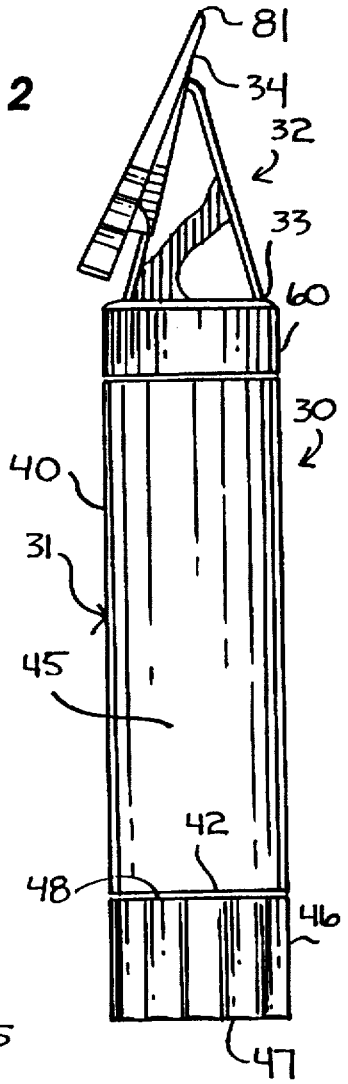
FIG. 2 is a side elevational view of the embodiment shown in FIG. 1.

With continuing reference to FIG. 1 and additional reference to FIG. 2 and FIG. 9, the vessel 31 includes a generally cylindrical member 40 having an open end 41, a closed end 42, an inner surface 43, a chamber 44, and an outer surface 45. Coupled to closed end 42 is shown handle member 46 which is fixedly and rotatably attached thereto. The handle member 46 includes an outer end 47 and an inner end 48 with an elongate threaded member 49 extending therefrom and terminating with an end 50. As can be seen in FIG. 10, a disk member 55 is threadably received by the threaded member 49 through a threaded aperture 56 formed through portions of the disk member 55. The disk member 55 further includes an upper surface 57, a generally cylindrical side surface 58, and a lower surface which is not herein specifically shown. The vessel 31 herein described is specifically designed, typically, for holding flowable material 36 such as caulking, glue, flowable adhesives, or like substances, peanut butter, jellies and jams, mayonnaise, mustard ketchup, or other like food substances. It will be appreciated by those of ordinary skill in the art that the flowable material may be dispensed from the open end 41 of the vessel 31 when force is exerted upon the flowable material 36 in the direction towards open end 41. Consistent with the referenced embodiment, the disk member 55 illustrated may be selectively moved towards the open end 41 upon rotation of the handle member 46 in the direction indicated by arrow A in FIG. 1, or arrow B in FIG. 9, thereby rotating the elongate threaded member 49 along the threaded portions of the threaded aperture 56, thereby forcing flowable material 36 out of the open end 41.

It will be readily appreciated by those of ordinary skill in the art that the vessel 31 and the elements herein described in combination therewith illustrate a means by which a selected flowable material may be held and dispensed. Such a configuration is well known in the prior art, and it will further be appreciated by those of ordinary skill that any preferred vessel capable of holding and dispensing a flowable material may be used in combination with the instant invention such as a squeeze tubes typically used in combination with toothpaste dispensers, or other like apparatus.

Attention is next directed to FIG. 3, FIG. 7, and FIG. 8, which illustrate details of the dispensing element 33. As can be seen, the dispensing element 33 preferably includes a base 60 having an end 61, a generally cylindrical side surface 62, and an upper surface 63. Also included is an upwardly extending portion 64 terminating with an end 64A. As can be seen in the above referenced drawings, the upwardly extending portion 64 is preferably generally triangular in shape tapering away from the base 60. The upwardly extending member includes side surfaces 65, rear surface 66, inner surface 67, a chamber 68 defined by inner surface 67, and a face member 69 having an outer surface 70, edges 71, top edge 72, and aperture 73 formed therethrough. The base 60 further includes an element of an engagement pair receivable by a complemental element of said engagement pair proximate the open end 41 of vessel 31. For the purposes of the preferred embodiment the element of the engagement pair proximate the base 60 includes a threaded portion 76, and the complemental element of the engagement pair proximate the open end 41 of vessel 31 includes a complemental threaded portion 77, the threaded portion 76 being threadably and fixedly receivable by the complemental threaded portion 77. It will be appreciated by those of ordinary skill, that although the engagement pair as herein specifically described includes threaded engagement elements, any suitable engagement means may be used in combination with the instant invention.

With continuing reference to FIG. 3, and additional reference to FIG. 4, FIG. 5, and FIG. 6, the carriage 34 of the dispensing assembly 32 includes a lower end 80, an upper edge 81, a substantially flat upper surface 82, a lower surface 83, a pair of diverging side surface portions 84, and textured side surface portions 85 which may be manually gripped. Upper edge 81 is a flowable material spreading edge which may either be straight as shown, serrated or contoured as selectively desired. Desirably, the carriage 34 is preferably tapered towards upper edge 81, which can readily be seen from the above referenced drawings.

As can be seen in FIG. 4, the lower surface 83 of the carriage 34 includes a pair of spaced apart outwardly extending brackets 86, each having an upper surface 87, an outer side surface 88, an inner side surface 89, an end surface 90, and a way 91 formed integral with the inner surface 89. Disposed between the brackets 86 is intermediate end wall 100 having an elongate member 101 extending outwardly therefrom and terminating with an end 102. The elongate member 101 includes a protruding member 103. As can be seen from FIG. 3 and FIG. 5, the carriage 34 is receivable by portions of the face member 69 when introduced thereto in the direction indicated by arrow C. The way 91, one of which being present in combination with each of the brackets 86, and the edges 71 of the face member 69, function together as a pair of opposed ways operative as engagement means, each edge 71 being slidably and frictionally receivable in each of the respective ways 91 formed in the brackets 86.

With continuing reference to FIG. 8, and additional reference to FIG. 12, FIG. 13, and FIG. 14, the face member 69 further includes a longitudinally extending groove 110 having a lower end 111, an upper end 112, and a detent 113. When the carriage 34 is introduced upon the dispensing element 33 in the direction of arrow D in FIG. 13, the pair of opposed ways become slidably and frictionally engaged, and concurrently therewith, the protruding member 103 becomes disposed within the detent 113 thereby retaining the carriage 34 in a fixed position or first configuration. The elongate member 101 is normally outwardly biased such that the protruding member 103 is biased towards detent 113 when the carriage 34 is introduced upon the dispensing element 33. As can be seen in FIG. 5, as a result of such a configuration, the aperture 73 becomes concealed by portions of the lower surface 83 of the carriage 34.

The protruding member 103 may be disengaged from the detent 113 by exerting pressure upon the carriage 34 in the direction of arrow C indicated in FIG. 3. Once the protruding member 103 becomes disengaged with the detent 113, the carriage 34 may be slide downwardly in the direction of arrow D thereby exposing the aperture 73, with the protruding member 103 riding in the groove 110. As a result of the normally outwardly biased configuration of the elongate member 101, the protruding member 103 is biased against the groove 110 in such a way the lower surface 83 of the carriage 34 becomes frictionally compressed against the outer surface 70 of the face member 69.

As can be appreciated from the description of the structural characteristics of the instant invention, when flowable material is forced towards the open end 41 of the vessel 31, it passes through the open end 41 and into the chamber 68 of the dispensing element 33 and upwardly in the direction towards the aperture 73 existent in the face member 69. When the protruding member 103 of the carriage 34 is disposed in the detent 113 defining the first configuration, the aperture 73 is concealed thereby denying the flowable material access through the aperture 73. When the protruding member 103 is disengaged from the detent 113 through the application of force exerted upon the carriage 34 in the direction indicated by arrow C in FIG. 3, the carriage 34 may be slide in the same direction with the protruding member 103 slidably and frictionally disposed in the groove 110. As can be seen in FIG. 10, once the carriage 34 is slide towards the base 60 of the dispensing assembly 32 in a second configuration, the aperture 73 becomes exposed thereby allowing flowable material 36 to pass therethrough and rest upon the upper surface 82 of the carriage 34. Once a selected amount of flowable material 36 has been dispensed from the aperture 73, the carriage 34 may then be selectively slid in the direction indicated by the arrow E in FIG. 10, thereby allowing the upper edge 81 of the carriage 34 to severe the flowable material 36 away from the aperture 73. The carriage 34 may also be further selectively moved in the direction indicated by arrow E until the protruding member 103 engages the detent 113, thereby allowing portions of the lower surface 83 of the carriage 34 to conceal aperture 73. The flowable material 36 disposed upon the upper surface 82 of the carriage 34 may then be selectively dispersed or spread upon surface 35 by means of the upper surface 82 of the carriage 34, and the upper edge 81 of the carriage 34.

Attention is next directed to the embodiment shown in FIG. 15, showing the dispensing assembly 32 with an alternate embodiment of the carriage 34. As can be seen, the carriage 34 shown in FIG. 15 includes a recessed portion 120 formed in the upper surface 82 for easy engagement with, for example, a finger, for easily moving the carriage 34 to a selected position. Additionally, the diverging side surface portions 84 do not include the textured side surface portions shown in reference to FIG. 10.

With attention directed to FIG. 16 and FIG. 17, shown is yet still another alternate embodiment of the dispensing assembly 32 showing the carriage 34 integrally attached to the dispensing element 33. The carriage 34 is shown having a cut-out portion defined by an inner end wall 121, and inner side walls 122, the inner side walls having ways 123 integrally existent therewith. Further included is a cap 124 having an upper edge 125, side edges 126, lower edge 127, and a lower surface not herein specifically shown. The side edges 126 of the cap 124 are slidingly and frictionally engageable with the ways 123 integral with the inner side walls 122, thereby facilitating the selective exposure of the aperture 73 when pressure is exerted upon the cap 124 in the direction of arrow F, or concealment of aperture 73 when pressure is exerted upon the cap 124 in the direction of arrow E in FIG. 10. The side edges 126 of the cap 124 and the ways 123 function as a pair of opposed ways slidably and frictionally engageable therewith one another. As can be seen from the referenced drawing, the dispensing element 33 includes runners 128 operative for aligning and directing the side edges 126 of the cap 124 with the ways 123.

Figure 18:
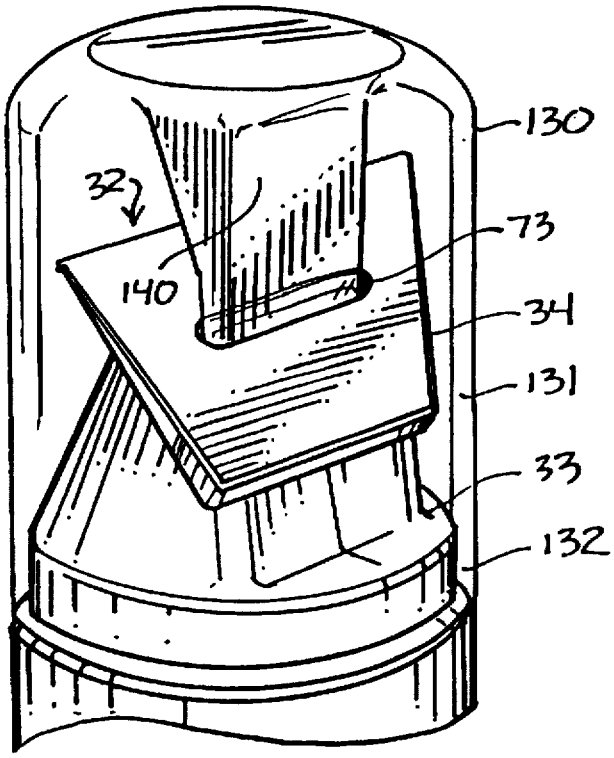
FIG. 18 is an enlarged fragmentary view of still a further alternate embodiment of the instant invention, and further illustrating a sealing member cooperative therewith.
Figure 19:
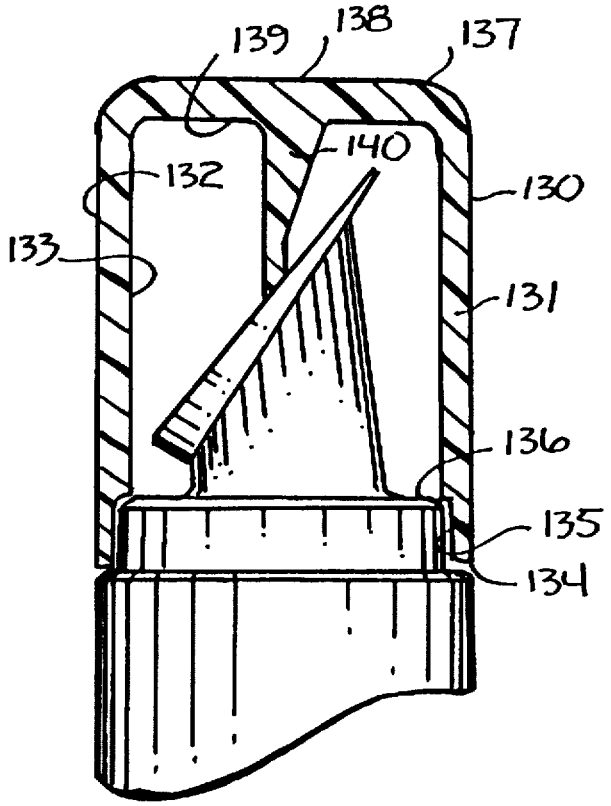
FIG. 19 is a side elevational view of the embodiment shown in FIG. 18.

With reference to FIG. 18 and FIG. 19, shown is yet still another alternate embodiment of the instant invention including the dispensing element 33 having the carriage 34 integrally attached thereto. The carriage 34 is shown having aperture 73 formed therethrough. The embodiment shown further includes a lid portion 130. The lid portion 130 includes a generally cylindrical body 131 having an outer surface 132, an inner surface 133, a lower end 134 having a recessed portion 135 terminating with an end wall 136 receivable against portions of the base 60 of the dispersing element 33. The lid portion 130 also includes a closed end 137 having an upper surface 138 and a lower surface 139. Depending from the lower surface 139 exists a plunger 140 receivably by aperture 73 for sealing aperture 73 when the lid portion 130 is disposed upon the dispensing assembly 32.

The lid portion 130 illustrated in FIG. 18 and FIG. 19 is shown as constructed of a transparent material such as clear plastic or the like. It will be readily appreciated by those of ordinary skill in the art that the lid portion 130 may be constructed of any preferred and suitable material.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

We claim:

1. The invention claimed is an apparatus for dispensing and dispersing material, said apparatus comprising:

a vessel for holding and dispensing a flowable material and having an open end; and a dispensing assembly coupled to said open end of said vessel, said dispensing assembly including a dispensing element closing said open end and having a face with an aperture therethrough for dispensing the flowable material, and a carriage having an edge and a planar surface for receiving the flowable material, said carriage movably coupled to said face of said dispensing element, moveable between a closed position covering the aperture and an open position with the edge of the carriage adjacent the aperture, whereby in the open position, the flowable material from the aperture is deposited onto the surface of the carriage proximate the edge to facilitate spreading of the flowable material on another surface.

2. The apparatus of claim 1, wherein said carriage further includes an element of an engagement pair and said dispensing element further includes a complemental element of said engagement pair, said element being fixedly and movably engageable to said complemental element.

3. The apparatus of claim 2, wherein said dispensing element includes:

a base engageable with said end of said vessel;

an upwardly extending portion terminating with an end;

a face member having an outer surface;

said aperture suitably formed through said face member proximate said end; and a chamber suitably positioned between said aperture and said base for receiving said flowable material dispensed from said vessel.

4. The apparatus of claim 3, wherein said engagement pair includes a pair of opposed ways, one of said ways, comprising portions of said element, carried proximate said carriage, and the other of said ways, comprising portions of said complemental element, carried proximate said face member.

5. The apparatus of claim 4, wherein said complemental element further includes a longitudinally extending groove, integral with said face member, and suitably spaced between said base and said aperture, said groove operative to receive portions of said element of said engagement pair.

6. The apparatus of claim 5, wherein said carriage further includes a lower surface, said element of said engagement pair being carried proximate said lower surface.

7. The apparatus of claim 6, wherein said element of said engagement pair further includes a male engagement member, said male engagement member being normally outwardly biased and slidably receivable by said groove concurrently upon engagement of said pair of opposed ways, said male engagement member operative for normally biasing said carriage against said face member, said carriage operative to expose said aperture when said carriage is disposed along said groove in a first position.

8. The apparatus of claim 7, wherein said longitudinally extending groove further includes a detent suitably located proximate a terminal portion of said groove, and sized for selectively retaining said male engagement member of said carriage in a second configuration thereby disposing portions of said carriage over said aperture for selectively closing said aperture.

9. What is claimed is a method for dispensing and spreading a flowable material upon a surface, said method comprising the steps of:

providing a vessel having an open end and containing a flowable material;

providing a dispensing assembly coupled to and closing said open end of said vessel, said dispensing assembly having an aperture for dispensing the flowable material, and a carriage movably coupled to said dispensing element, the carriage moveable between a closed position covering the aperture and an open position adjacent the aperture, and having a surface for receiving the flowable material dispensed from said aperture, in the open position;

moving said carriage to the open position;

dispensing said flowable material from the vessel through the aperture;

receiving said flowable material dispensed from the vessel through the aperture, on said surface of said carriage;

moving said carriage to the closed position thereby closing the aperture, spreading said flowable material with said carriage.

* * * * *